US010341759B2

(12) United States Patent
Dusan et al.

(10) Patent No.: US 10,341,759 B2
(45) Date of Patent: Jul. 2, 2019

(54) SYSTEM AND METHOD OF WIND AND NOISE REDUCTION FOR A HEADPHONE

(71) Applicant: Apple Inc., Cupertino, CA (US)

(72) Inventors: Sorin V. Dusan, San Jose, CA (US); Tom-Davy W. Saux, Santa Clara, CA (US); Vladan Bajic, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/607,051

(22) Filed: May 26, 2017

(65) Prior Publication Data

US 2018/0343514 A1 Nov. 29, 2018

(51) Int. Cl.

| | |
|---|---|
| ***G10L 21/0208*** | (2013.01) |
| ***G10L 21/0216*** | (2013.01) |
| ***H04R 1/10*** | (2006.01) |
| ***G10K 11/178*** | (2006.01) |

(52) U.S. Cl.

CPC ..... *H04R 1/1083* (2013.01); *G10K 11/178* (2013.01); *G10L 21/0208* (2013.01); *G10K 2210/1081* (2013.01); *G10L 2021/02082* (2013.01)

(58) Field of Classification Search

CPC ..... H04R 1/1083; G10K 11/178; G10K 11/1788; G10K 2210/1081; G10L 21/0208; G10L 21/0216; G10L 2021/02082

USPC ..... 704/226, 500; 381/71.1, 74, 71.2, 71.3, 381/71.4

See application file for complete search history.

(56) References Cited

U.S. PATENT DOCUMENTS

| | | | | |
|---|---|---|---|---|
| 8,515,089 | B2 | 8/2013 | Nicholson | |
| 8,724,798 | B2 | 5/2014 | Smaragdis et al. | |
| 9,204,214 | B2 | 12/2015 | Usher et al. | |
| 2012/0278070 | A1* | 11/2012 | Herve | G10L 21/0208 704/226 |
| 2014/0064476 | A1* | 3/2014 | Mani | H04M 9/082 379/406.08 |

(Continued)

FOREIGN PATENT DOCUMENTS

WO 2016186997 A1 11/2016

*Primary Examiner* — Paul Kim
*Assistant Examiner* — Ubachukwu A Odunukwe
(74) *Attorney, Agent, or Firm* — Womble Bond Dickinson (US) LLP

(57) ABSTRACT

Method of wind and noise reduction for headphones starts by receiving acoustic signals from first external microphone included on the outside of earcup's housing. Acoustic signals are received from internal microphone included inside earcup's housing. ANC downlink corrector processes downlink signal to generate echo estimate of speaker signal. First summator removes echo estimate of speaker signal from acoustic signals from internal microphone to generate corrected internal microphone signal. Spectral combiner performs spectral mixing of corrected internal microphone signal with acoustic signals from first external microphone to generate mixed signal. Lower frequency portion of mixed signal includes corresponding lower frequency portion of corrected internal microphone signal, and higher frequency portion of mixed signal includes corresponding higher frequency portion of acoustic signals from first external microphone. Other embodiments are also described.

22 Claims, 7 Drawing Sheets

(56) References Cited

U.S. PATENT DOCUMENTS

| | | | | |
|---|---|---|---|---|
| 2014/0072135 | A1* | 3/2014 | Bajic | G10K 11/178 381/71.11 |
| 2014/0105413 | A1 | 4/2014 | Clemow | |
| 2015/0325251 | A1* | 11/2015 | Dusan | G10L 21/0216 704/226 |
| 2017/0125006 | A1 | 5/2017 | Dzhigan et al. | |

* cited by examiner

SYSTEM AND METHOD OF WIND AND NOISE REDUCTION FOR A HEADPHONE

FIELD

Embodiments of the invention relate generally to a system and method of wind and noise reduction for a headphone. Specifically, embodiments of the invention performs spectral mixing of signals from a microphone located inside the earcup (or ear bud, or phone) that is directed towards the ear canal (e.g., error microphone) with the signals from at least one microphone located on the outside of the earcup's housing to generate a mixed signal. In some embodiments, the signals from the internal microphone is also subject to a version of an adaptive noise cancelling technique to further enhance the internal microphone signal before the spectral mixing.

BACKGROUND

Currently, a number of consumer electronic devices are adapted to receive speech via microphone ports or headsets. While the typical example is a portable telecommunications device (mobile telephone), with the advent of Voice over IP (VoIP), desktop computers, laptop computers and tablet computers may also be used to perform voice communications.

When using these electronic devices, the user also has the option of using headphones, earbuds, or headset to receive his speech. However, a common complaint with these hands-free modes of operation is that the speech captured by the microphone port or the headset includes environmental noise such as wind noise, secondary speakers in the background or other background noises. This environmental noise often renders the user's speech unintelligible and thus, degrades the quality of the voice communication.

SUMMARY

Generally, embodiments of the invention relate to a system and method of wind and noise reduction for a headphone. Embodiments of the invention apply to wireless or wired headphones, headsets, phones, and other communication devices that users can wear on or hold at their head or ears. By reducing the wind and noise in the signals captured by the microphones, the speech quality and intelligibility of the uplink signal is enhanced. Specifically, embodiments of the invention spectrally mix signals from a microphone located inside the earcup (or ear bud, or phone) that is directed towards the ear canal (e.g., error microphone) with the signals from at least one microphone located on the outside of the earcup's housing to generate a mixed signal. In some embodiments, the signals from the internal microphone is also subject to a version of an adaptive noise cancelling technique to further enhance the internal microphone signal before the spectral mixing.

In one embodiment, a method of wind and noise reduction for a headphone starts by receiving acoustic signals from a first external microphone included on an outside of a housing of an earcup of the headphone. Acoustic signals are also received from an internal microphone which is included inside the housing of the first earcup. A downlink signal is then processed to generate an echo estimate of a speaker signal to be output by a speaker. The echo estimate of the speaker signal is removed from the acoustic signals from the internal microphone to generate a corrected internal microphone signal. The corrected internal microphone signal is spectrally mixed with the acoustic signals from the first external microphone to generate a mixed signal. The lower frequency portion of the mixed signal includes a corresponding lower frequency portion of the corrected internal microphone signal. The higher frequency portion of the mixed signal includes a corresponding higher frequency portion of the acoustic signals from the first external microphone.

In another embodiment, the method receives acoustic signals from a first external microphone and a second external microphone. The first and second external microphones are included on an outside of a housing of an earcup of the headphone. A beamformer generates a voicebeam signal based on the first external microphone signal and the second external microphone signal. Acoustic signals are received from an internal microphone included inside the housing of the earcup. A downlink signal is processed to generate an echo estimate of a speaker signal to be output by a speaker. The echo estimate of the speaker signal is removed from the acoustic signals from the internal microphone to generate a corrected internal microphone signal. In this embodiment, the corrected internal microphone signal is spectrally mixed with the voicebeam signal to generate a mixed signal. The lower frequency portion of the mixed signal includes a corresponding lower frequency portion of the corrected internal microphone signal, and the higher frequency portion of the mixed signal includes a corresponding higher frequency portion of the voicebeam signal.

In another embodiment, a system of noise reduction for a headphone comprises: a speaker to output a speaker signal based on a downlink signal, an earcup of the headphone, an active-noise cancellation (ANC) downlink corrector, a first summator, a first and second acoustic echo canceller, an equalizer and a spectral combiner. The earcup includes a first external microphone included on an outside of a housing of the first earcup, and an internal microphone included inside the housing of the first earcup. The ANC downlink corrector processes the downlink signal to generate an echo estimate of the speaker signal. The first summator removes the echo estimate of the speaker signal from acoustic signals from the internal microphone to generate a corrected internal microphone signal. The first acoustic echo canceller removes a linear acoustic echo from acoustic signals from the first external microphone based on a downlink signal to generate an enhanced first external microphone signal and the second acoustic echo canceller removes a linear acoustic echo from the corrected internal microphone signal based on the downlink signal to generate an enhanced internal microphone signal. The equalizer scales the enhanced internal microphone signal to match a level of the enhanced first external microphone signal. The spectral combiner spectrally mixes the enhanced internal microphone signal with the enhanced first external microphone signal to generate a mixed signal. The lower frequency portion of the mixed signal includes a corresponding lower frequency portion of the enhanced internal microphone signal, and the higher frequency portion of the mixed signal includes a corresponding higher frequency portion of the enhanced first external microphone signal.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 1:
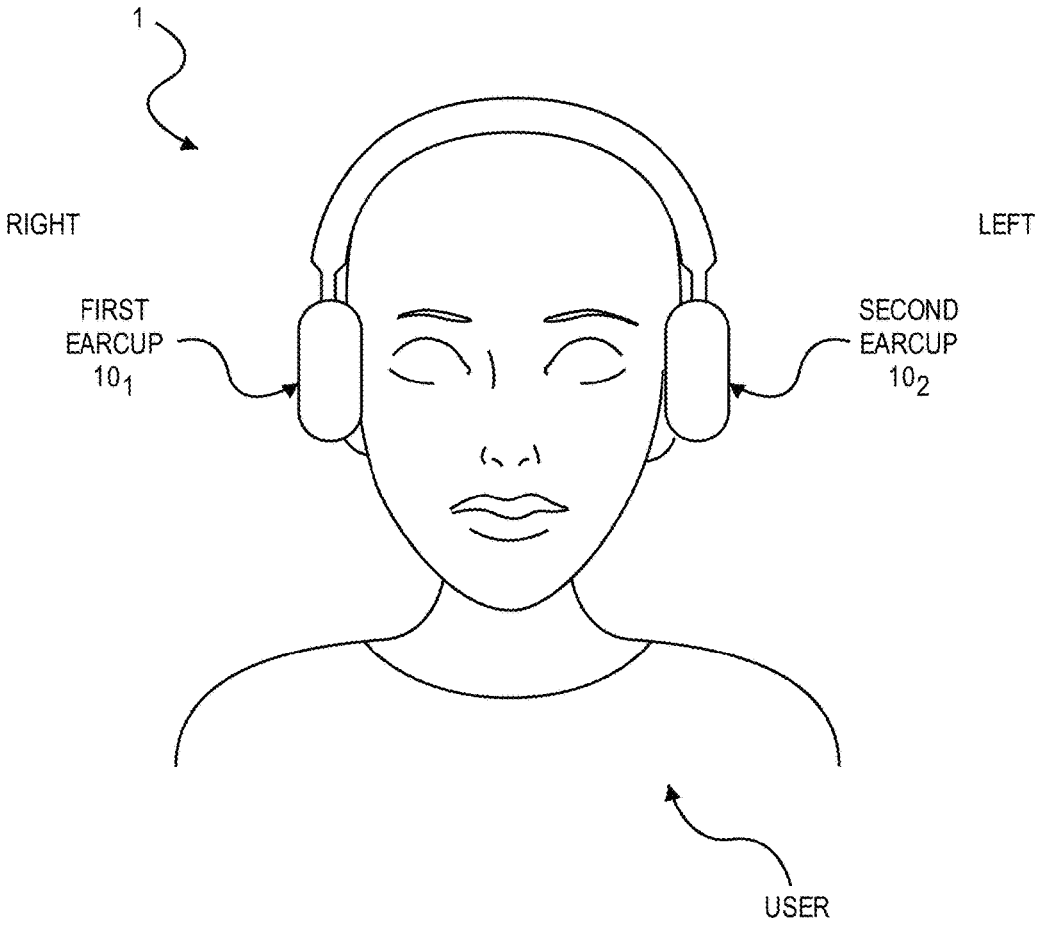
FIG. 1 illustrates an example of headphones in use according to one embodiment of the invention.

FIG. 1 illustrates an example of headphones in use according to one embodiment of the invention. The headphone in FIG. 1 is double-earpiece headset. The headphone includes a first earcup $\mathbf{10}_1$ and a second earcup $\mathbf{10}_2$ that are to be placed over the user's ears. While the headphone including earcups is discussed herein, it is understood that headphone that includes a pair of earbuds that are placed in the user's ear may also be used. Additionally, embodiments of the invention may also use other types of headsets, wired or wireless headphones, phones, and other voice communication devices that users can wear on or hold at their heads or ears. In one embodiment, the headphone is worn in normal wear position when the both earcups are placed on the user's ears and the headband portion of the headphone is at the top most portion of the user's head (e.g., the headphone is not worn off-angle).

The headphone on FIG. 1 may be coupled to a consumer electronic device (or mobile device) (not shown) via a wire or wirelessly. In some embodiments, the earcups $\mathbf{10}_1$, $\mathbf{10}_2$ may be wireless and communicate with each other and with the electronic device 100 via BlueTooth™ signals. Thus, the earcups $\mathbf{10}_1$, $\mathbf{10}_2$ may not be connected with wires to the electronic device 100 (not shown) or between them, but communicate with each other to deliver the uplink (or recording) function and the downlink (or playback) function.

Figure 2:
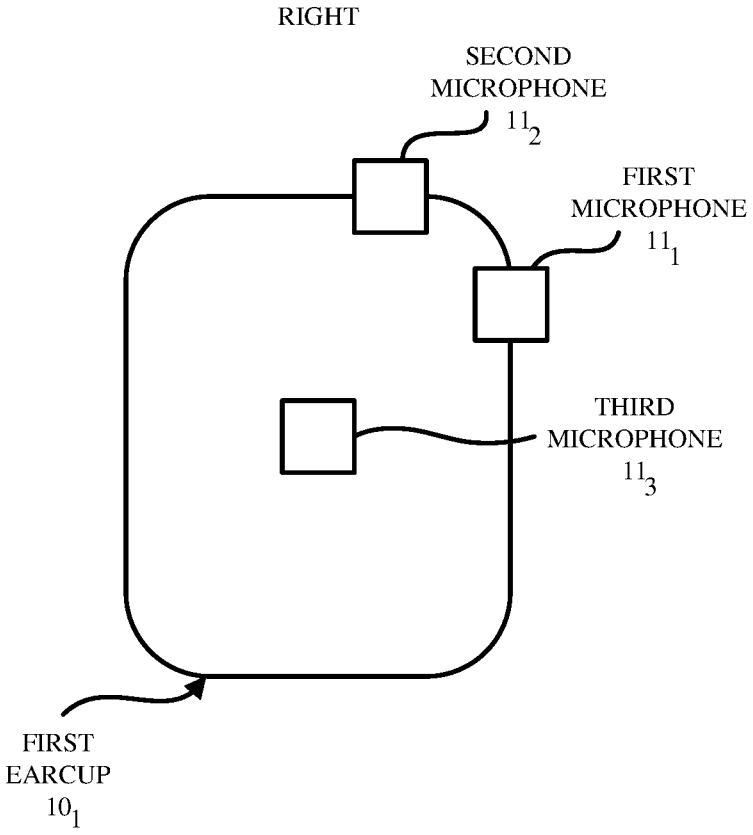
FIG. 2 illustrates an example of the details of one of the earcups in accordance with one embodiment of the invention.

FIG. 2 illustrates an example of the details of one of the earcups $\mathbf{10}_1$ in accordance with one embodiment of the invention. The earcups $\mathbf{10}_1$, $\mathbf{10}_2$ may be identical or mirror images of each other. It is understood that the earcups $\mathbf{10}_1$, $\mathbf{10}_2$ are identical or mirror images of each other within manufacturing tolerances. Each of the earcups includes a plurality of microphones $\mathbf{11}_1$-$\mathbf{11}_3$ that may receive the user's speech. The microphones $\mathbf{11}_1$-$\mathbf{11}_3$ may be air interface sound pickup devices that convert sound into an electrical signal. As the user is using the headset to transmit her speech, environmental noise may also be present.

As shown in FIG. 2, the earcup $\mathbf{10}_1$ includes three microphones being the first microphone $\mathbf{11}_1$, the second microphone $\mathbf{11}_2$ and the third microphone $\mathbf{11}_3$. In this embodiment, the first microphone $\mathbf{11}_1$ is located on the outside of the housing of the earcup $\mathbf{10}_1$ (e.g., first outside or external microphone $\mathbf{11}_1$) facing an exterior of the earcup $\mathbf{10}_1$. The first microphone $\mathbf{11}_1$ may be located on a perimeter of the earcup $\mathbf{10}_1$. Similarly, as shown in FIG. 2, the second microphone $\mathbf{11}_2$ is also located on the outside of the housing of the earcup $\mathbf{10}_1$ (e.g., second outside or external microphone) facing an exterior of the earcup $\mathbf{10}_1$. The second microphone $\mathbf{11}_2$ may be located on the perimeter of the earcup $\mathbf{10}_1$. It is understood that the locations of the first and second external microphones $\mathbf{11}_1$, $\mathbf{11}_2$ may be at different locations on the outside of the housing of the earcup $\mathbf{10}_1$ facing the exterior of the earcup $\mathbf{10}_1$. The first and second external microphones $\mathbf{11}_1$, $\mathbf{11}_2$ may be used to create a microphone array (i.e., beamformers) which can be aligned in the direction of user's mouth. Accordingly, the beamforming process, also referred to as spatial filtering, may be a signal processing technique using the microphone array for directional sound reception.

The third microphone $\mathbf{11}_3$ is located inside each earcup facing the user's ear cavity (e.g., inside microphone, internal microphone, or error microphone). Since the third microphone $\mathbf{11}_3$ is located against or in the ear and the third microphone $\mathbf{11}_3$ is placed inside the earcup $\mathbf{10}_1$, the third microphone $\mathbf{11}_3$ is protected from external noises such as ambient noise, environmental noise, and wind noise. In some embodiments, the location of the third microphone $\mathbf{11}_3$ captures acoustic signals having ambient noises attenuated by 10 db-20 db and wind noises attenuated by 15-20 db. In one embodiment, the earcup is an earbud such that the third microphone $\mathbf{11}_3$ is located on the portion of the earbud (e.g., tube) that is placed in the user's ear such that the third microphone $\mathbf{11}_3$ is as close as possible to the user's eardrum. In some embodiments, at least one of the external microphones $\mathbf{11}_1$, $\mathbf{11}_2$, and the internal microphone $\mathbf{11}_3$ can be used to perform active noise cancellation (ANC).

While FIG. 2 illustrates the first earcup $\mathbf{10}_1$ including three microphones (e.g., two external microphones and one internal microphone), in one embodiment, the earcup $\mathbf{10}_1$ may only include one external microphone and one internal microphone. In other embodiment, the earcup $\mathbf{10}_1$ may include more than two external microphones and one internal microphone.

While not shown in the FIG. 2, the earcups $\mathbf{10}_1$, $\mathbf{10}_2$ may also respectively include speakers to generate the audio signals corresponding to the left and right stereo channels.

The headphone may also include one or more integrated circuits and a jack to connect the headphone to the electronic device (not shown) using digital signals, which may be sampled and quantized.

In another embodiment, the earcups $\mathbf{10}_1$, $\mathbf{10}_2$ are wireless and may also include a battery device, a processor, and a communication interface (not shown). In this embodiment, the processor may be a digital signal processing chip that processes the acoustic signal from the microphones $\mathbf{11}_1$-$\mathbf{11}_3$. In one embodiment, the processor may control or include at least one of the elements illustrated in the system 3 in FIG. 3.

The communication interface may include a Bluetooth™ receiver and transmitter which may communicate speaker audio signals or microphone signals from the microphones $\mathbf{11}_1$-$\mathbf{11}_3$ wirelessly in both directions (uplink and downlink) with the electronic device. In some embodiments, the communication interface communicates encoded signal from a speech codec (not shown) to the electronic device.

Figure 3:
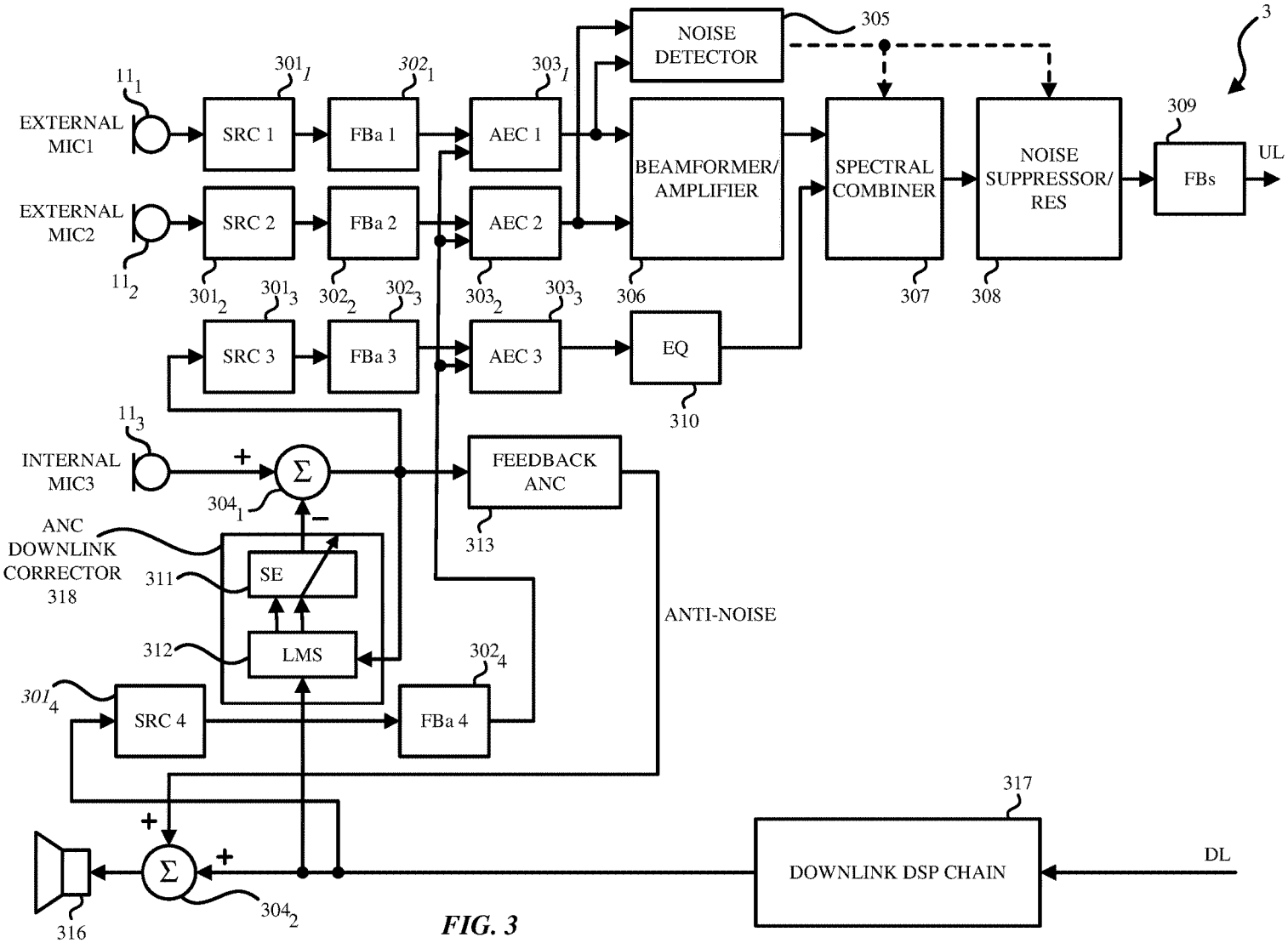
FIG. 3 illustrates a block diagram of a system of wind and noise reduction for a headphone according to an embodiment of the invention.

FIG. 3 illustrates a block diagram of a system 3 of wind and noise reduction for a headphone according to an embodiment of the invention. The elements included in the system 3 may be included in the headphone or in the electronic device (e.g., mobile device) coupled to the headphone.

As shown in FIG. 3, the speaker 316 may be included in the earcup $\mathbf{10}_1$. The speaker 316 generates a speaker signal based on a downlink signal that is processed by the downlink digital signal processing (DSP) chain 317.

In the embodiment in FIG. 3, the system 3 includes the first microphone $\mathbf{11}_1$ (e.g., first external microphone) and the second microphone $\mathbf{11}_2$ (e.g., second external microphone) that are included on an outside of a housing of the earcup $\mathbf{10}_1$. The system 3 includes the third microphone $\mathbf{11}_3$ that is located inside the housing of the earcup $\mathbf{10}_1$ (e.g., internal microphone). The third microphone $\mathbf{11}_3$ may be located at a location closest to the user's ear canal when the headphone is worn on the user's ears.

Embodiments of the invention may be applied in time domain or in frequency domain. In one embodiment, the sample rate converters (SRC) $\mathbf{301}_1$-$\mathbf{301}_3$ in FIG. 3 process the acoustic signals captured by the microphones $\mathbf{11}_1$, $\mathbf{11}_2$, $\mathbf{11}_3$, respectively to be sampled at a predetermined sampling frequency (e.g., a higher frequency of 48 kHz). The sample rate converters (SRC) $\mathbf{301}_4$ receives the downlink signal that was processed by the downlink DSP chain 317 and processes the downlink signal to be sampled at the predetermined sampling frequency (e.g., a higher frequency of 48 kHz).

The time-frequency transformers (FBa) $\mathbf{302}_1$-$\mathbf{302}_3$ transform the acoustic signals from the first microphone $\mathbf{11}_1$, the acoustic signals from the second microphone $\mathbf{11}_2$, and the acoustic signal from the third microphone $\mathbf{11}_3$, from a time domain to a frequency domain. Similarly, the time-frequency transformer (FBa) $\mathbf{302}_4$ transforms the downlink signal from a time domain to a frequency domain.

An active-noise cancellation (ANC) downlink corrector 318 processes the downlink signal from the downlink DSP chain 37 to generate an echo estimate of the speaker signal. A first summator $\mathbf{304}_1$ receives the acoustic signals from the third microphone (e.g., internal microphone) $\mathbf{11}_3$ and the echo estimate of the speaker signal from the ANC downlink corrector 318. The first summator $\mathbf{304}_1$ removes the echo estimate of the speaker signal from acoustic signals from the internal microphone to generate a corrected internal microphone signal. Accordingly, the first summator $\mathbf{304}_1$ extracts from the internal microphone signal the echo generated by the downlink signal that is produced by the speaker 316 which may be included in the earcup $\mathbf{10}_1$ or the electronic device. This extraction further preserves the level of the speaker signal being played by the speaker 316.

Given the earcup $\mathbf{10}_1$'s occlusion on the user's ear, the user's speech that is captured by the third microphone $\mathbf{11}_3$ is amplified at low frequencies comparing with the external microphones $\mathbf{11}_1$ and $\mathbf{11}_2$. To reduce this amplification to a level close to what the user would hear normally without the earcup occlusion, a feedback ANC corrector 313 processes the corrected internal microphone signal from the first combiner $\mathbf{304}_1$ and generates an anti-noise signal. A second summator $\mathbf{304}_2$ receives the anti-noise signal and the downlink signal from the downlink DSP chain 317. The second summator $\mathbf{304}_2$ adds the anti-noise signal to the downlink signal to generate the speaker signal. The speaker signal is then played or output by the loudspeaker 316.

As further shown in FIG. 3, the ANC downlink corrector 318 may also receive the corrected internal microphone signal from the first summator $\mathbf{304}_1$ and the downlink signal from the DSP chain 317. The ANC downlink corrector 318 may also include the system estimator (SE) 311 that receives the downlink signal from the DSP chain 317 and applies the system estimate to generate the echo estimate of the speaker signal. The ANC downlink corrector 318 may include an LMS 312 module that receives the downlink signal from the DSP chain 317 and the signal after the first summator $\mathbf{304}_1$ and computes the adaptation parameters of the SE 311 module.

Referring back to the uplink signal processing, in FIG. 3, the sample rate converters (SRC) $\mathbf{301}_3$ receives the corrected internal microphone signal from the first summator $\mathbf{304}_1$ and processes the corrected internal microphone signal to be sampled at the predetermined sampling frequency (e.g., a lower frequency of 16 kHz). The time-frequency transformers (FBa) $\mathbf{302}_3$ transforms the corrected internal microphone signal from a time domain to a frequency domain.

The time-frequency transformers (FBa) $\mathbf{302}_1$-$\mathbf{302}_4$ may transform the signals from a time domain to a frequency domain by filter bank analysis. In one embodiment, the time-frequency transformers (FBa) $\mathbf{302}_1$-$\mathbf{302}_4$ may transform the signals from a time domain to a frequency domain using the Fast Fourier Transforms (FFT).

Acoustic echo cancellers (AEC) $\mathbf{303}_1$-$\mathbf{303}_3$ provide additional echo suppression. For example, the first AEC $\mathbf{303}_1$ removes a linear acoustic echo from acoustic signals from the first external microphone $\mathbf{11}_1$ in the frequency domain based on a downlink signal in the frequency domain to generate an enhanced first external microphone signal in the frequency domain. The second AEC $\mathbf{303}_2$ removes a linear acoustic echo from acoustic signals from the second external microphone $\mathbf{11}_2$ in the frequency domain based on a downlink signal in the frequency domain to generate an enhanced second external microphone signal in the frequency domain. The third AEC $\mathbf{303}_3$ removes a linear acoustic echo from the corrected internal microphone signal in the frequency domain based on the downlink signal in the frequency domain to generate an enhanced internal microphone signal in the frequency domain.

A beamformer 306 is generating a voicebeam signal based on the enhanced first external microphone signal in the frequency domain and the enhanced second external microphone signal in the frequency domain.

In one embodiment, when only one external microphone is included in the system 3 (e.g., first microphone 110, instead of a beamformer 306, the system 3 includes an amplifier 306 that is a single-microphone amplifier to amplify the enhanced first external microphone signal to generate an amplified enhanced first external microphone signal which is transmitted to the spectral combiner 307 in lieu of the voicebeam signal.

While the beamformer 306 is able to help capture the sounds from the user's mouth and attenuate some of the environmental noise, when the power of the environmental noise (or ambient noise) is above a given threshold or when wind noise is detected in at least two microphones, the acoustic signals captured by the beamformer 306 may not be adequate. Accordingly, in one embodiment of the invention, rather than only using the acoustic signals captured by the beamformer 306, the system 3 performs spectral mixing of the acoustic signals from the internal microphone $\mathbf{11}_3$ and the voicebeam signal from the beamformer 306 to generate a mixed signal. In another embodiment, the system 3 performs spectral mixing of the acoustic signals from internal microphone $\mathbf{11}_3$ with the acoustic signals captured by at least one of the external microphones $\mathbf{11}_1$, $\mathbf{11}_2$ or a combination of them to generate a mixed signal.

As shown in FIG. 3, a wind and noise detector 305 receive the enhanced first external microphone signal in the frequency domain and the second external microphone signal in the frequency domain from the first and second AECs $\mathbf{303}_1$, $\mathbf{303}_2$ respectively. In some embodiments, the wind and noise detector 305 detects wind noise in at least two of the microphones when the cross-correlation between two of the microphones is below a pre-determined threshold. In some embodiments, the noise and noise detector 305 detects ambient noise when the acoustic noise power signal is greater than the pre-determined threshold. The wind and noise detector 305 generates a detector output that indicates whether noise such as ambient noise and wind noise is detected in the enhanced first external microphone signal in the frequency domain and the second external microphone signal in the frequency domain.

In one embodiment, when only one external microphone is included in the system 3 (e.g., first microphone $\mathbf{11}_1$), the wind and noise detector 305 only receives the enhanced first external microphone signal in the frequency domain from the first AEC $\mathbf{303}_1$ and determines whether noise such as ambient noise and wind noise is detected in the enhanced first external microphone signal. In this embodiment, the noise detector detects ambient and wind noise when the acoustic noise power signal is greater than the pre-determined threshold. The wind and noise detector 305 generates the detector output to indicate whether the ambient or wind noise is detected in the enhanced first external microphone signal.

In one embodiment, an equalizer 310 scales the enhanced internal microphone signal in the frequency domain to match a level of the enhanced first external microphone signal. The equalizer 310 corrects the frequency response of the third microphone $\mathbf{11}_3$ (e.g., internal microphone) to match the frequency response of the first or second external microphones $\mathbf{11}_1$, $\mathbf{11}_2$. In one embodiment, the equalizer 310 may scale the enhanced internal microphone signal by a fixed scaling quantity. In another embodiment, the equalizer 310 may adaptively scale the enhanced internal microphone signal based on a comparison of the magnitudes of the signals from the first AEC $\mathbf{303}_1$ and the third AEC $\mathbf{303}_3$ at run time.

In FIG. 3, a spectral combiner 307 receives the voicebeam from the beamformer 306 and the scaled enhanced internal microphone signal, which is the output from the equalizer 310. The spectral combiner 307 performs spectral mixing of the output of the equalizer 310 with the voicebeam signal to generate the mixed signal or with the first microphone signal amplified by module 306.

Figure 4A:
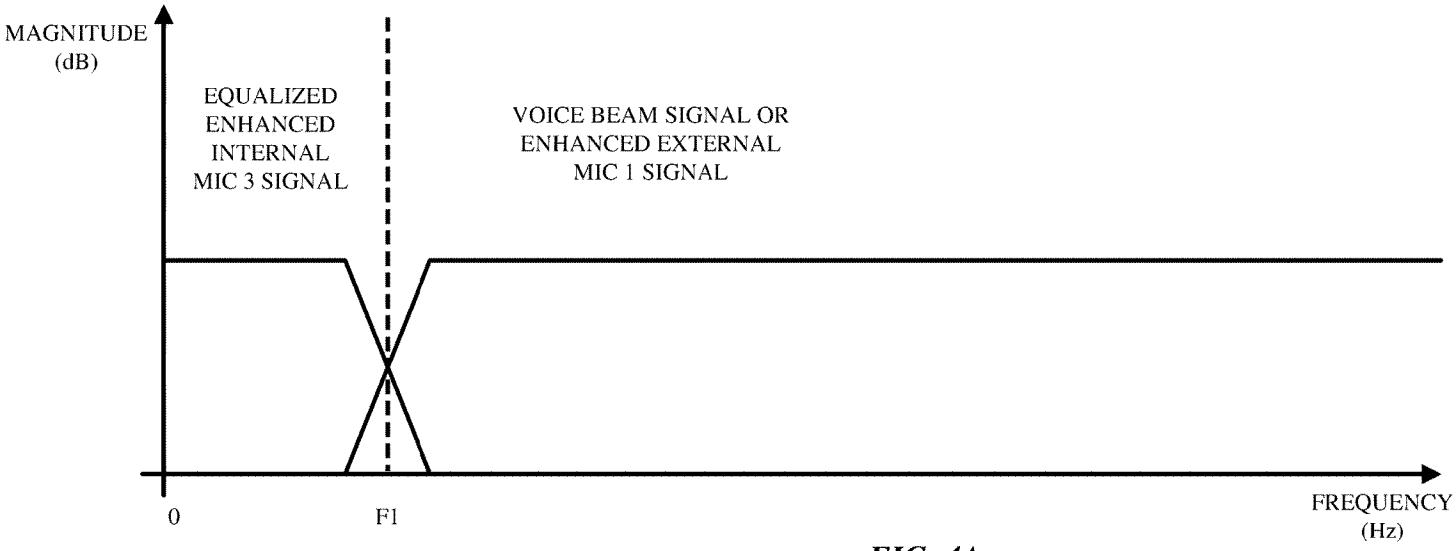
FIGS. 4A-4B illustrate exemplary graphs of the signals from the internal microphone and from the external microphone (or beamformer) in the earcup on which spectral mixing is performed according to one embodiment of the invention.
Figure 4B:
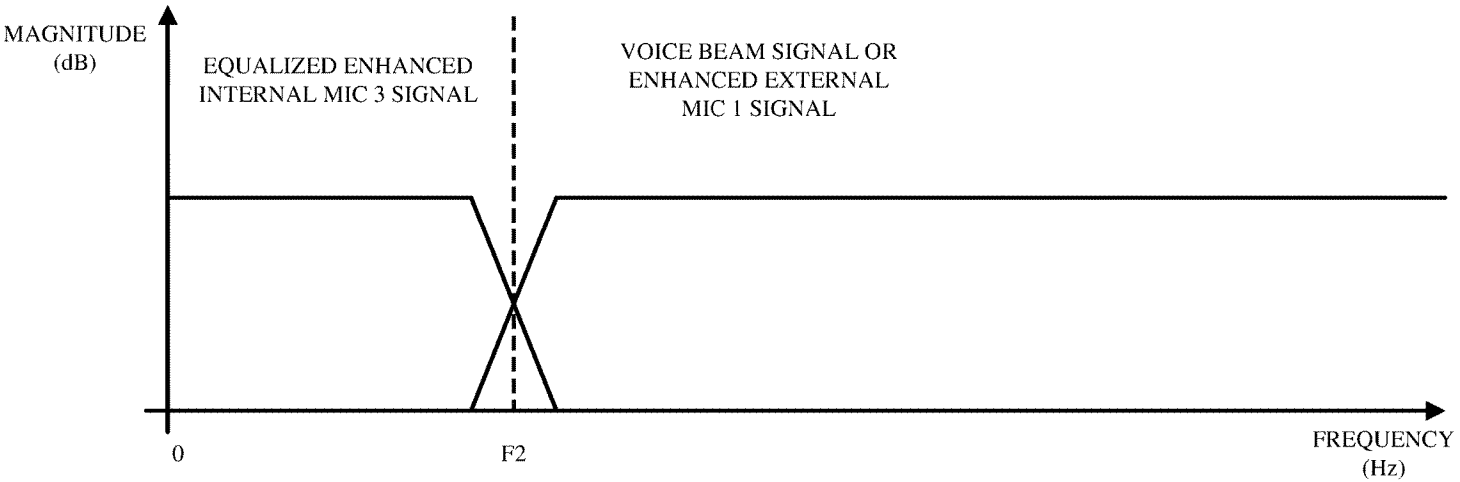

FIGS. 4A-4B illustrate exemplary graphs of the signals from the internal microphone $\mathbf{11}_3$ (or scaled enhanced internal microphone signal) and from the first external microphone $\mathbf{11}_1$ or from the beamformer 306 in the earcup $\mathbf{10}_1$ on which spectral mixing is performed according to one embodiment of the invention. Most naturally occurring noises have strong low frequency components that decay with increasing frequency. FIG. 4A illustrates the spectral mixing in case of ambient noise and FIG. 4B illustrates the spectral mixing in case of wind noise. As shown in FIGS. 4A-4B, the signals from the internal microphone $\mathbf{11}_3$ (or scaled enhanced internal microphone signal) are generated at lower frequencies whereas the signals from the first external microphone $\mathbf{11}_1$ or from the beamformer 306 are generated at higher frequencies.

As shown in FIG. 4A, when environmental (or ambient) noise is detected, the signals from the internal microphone $\mathbf{11}_3$ (or scaled enhanced internal microphone signal) account for the low frequency band (e.g., 300 Hz-500 Hz and under) of the mixed signal and the acoustic signal received from the first external microphone $\mathbf{11}_1$ or from the beamformer 306 accounts for the high frequency band (e.g., over 300-500 Hz). Accordingly, as shown in FIG. 4A, the lower frequency portion of the mixed signal is between 0 Hz and the cutoff frequency F1 (e.g., 300-500 Hz) and the higher frequency portion of the mixed signal is between the cutoff frequency F1 (e.g., 300-500 Hz) and the Nyquist frequency. As shown in FIG. 4B, when wind noise is detected, the signals from the internal microphone $\mathbf{11}_3$ (or scaled enhanced internal microphone signal) account for the low frequency band (e.g., 800-1500 Hz and under) of the mixed signal and the acoustic signal received from the first external microphone $\mathbf{11}_1$ or from the beamformer 306 accounts for the high frequency band (e.g., over 800-1500 Hz). Accordingly, as shown in FIG. 4B, the lower frequency portion of the mixed signal is between 0 Hz and the cutoff frequency F2 (e.g., 800-1500 Hz) and the higher frequency portion of the mixed signal is between the cutoff frequency F2 (e.g., 800-1500 Hz) and the Nyquist frequency. In some embodiments, the cutoff frequency F1 is lower than the cutoff frequency F2.

Since acoustic signals from the internal microphone $\mathbf{11}_3$ are more robust to the wind and ambient noise than the external microphones $\mathbf{11}_1$, $\mathbf{11}_2$ (or voicebeam signal from the beamformer 306), a lower frequency portion of the mixed signal generated by the spectral combiner 307 includes a corresponding lower frequency portion of the corrected internal microphone signal and a higher frequency portion of the mixed signal includes a corresponding higher frequency portion of the voicebeam signal. The mixed signal generated by the spectral combiner 307 includes the lower frequency portion and the higher frequency portion.

In the embodiment where only one external microphone is included in the system 3 (e.g., first microphone $\mathbf{11}_1$), the spectral combiner spectrally mixes the enhanced internal microphone signal with the enhanced first external microphone signal to generate a mixed signal. In one embodiment, prior to the spectral mixing, a single microphone amplifier may amplify the enhanced first external microphone signal as discussed above. In this embodiment, a lower frequency portion of the mixed signal includes a corresponding lower frequency portion of the enhanced internal microphone signal, and a higher frequency portion of the mixed signal includes a corresponding higher frequency portion of the enhanced first external microphone signal.

As shown in FIG. 3, the spectral combiner 307 receives the detector output from the noise detector 305, which indicates whether noise is detected. In one embodiment, when the detector output indicates that no noise is detected, the spectral combiner 307 may not perform spectral mixing and may output only the voicebeam signal from the beamformer 306. When the detector output indicates that noise is detected, the spectral combiner 307 may perform spectral mixing of the signals from the internal microphone $\mathbf{11}_3$ (or scaled enhanced internal microphone signal) and from the first external microphone $\mathbf{11}_1$ or from the beamformer 306.

In one embodiment, the wind and noise detector 305 may generate a detector output that indicates that noise is detected and further indicates the type of noise that is detected. For example, the detector output may indicate that the type of noise detected is either ambient noise or wind noise. As shown in FIGS. 4A-4B, the spectral mixing of the signals from the internal microphone $\mathbf{11}_3$ (or scaled enhanced internal microphone signal) and from the first external microphone $\mathbf{11}_1$ or from the beamformer 306 in the earcup $\mathbf{10}_1$ is optimized by determining the cut-off frequency (e.g., F1 in FIG. 4A and F2 in FIG. 4B). Accordingly, when the detector output indicates that noise is detected and that the noise is ambient noise, the spectral combiner 307 generate a mixed signal that includes a lower frequency portion that is between 0 Hz and the cutoff frequency F1 and a higher frequency portion that is between the cutoff frequency F1 and the Nyquist frequency. In this embodiment, when the detector output indicates that noise is detected and that the noise is wind noise, the spectral combiner 307 generate a mixed signal that includes a lower frequency portion that is between 0 Hz and the cutoff frequency F2 and a higher frequency portion that is between the cutoff frequency F2 and the Nyquist frequency. It is understood that various cutoff frequencies for cross-fading may be used based on wind/noise type. It is understood that various cutoff frequencies for cross-fading may also be used based on noise/wind energy levels.

In one embodiment, the spectral combiner 307 may include a low-pass filter and a high-pass filter. The low-pass filter applies the cutoff frequency (e.g., F1 or F2) to the acoustic signals from the internal microphone $\mathbf{11}_3$ (or scaled enhanced internal microphone signal) and the high-pass filter applies the cutoff frequency (e.g., F1 or F2) to the acoustic signals from the first external microphone $\mathbf{11}_1$ or to the voicebeam signal from the beamformer 306 to generate the mixed signal.

Referring to FIG. 3, the noise suppressor 308 may suppress noise in the mixed signal based on the detector output received from the noise detector 305. For example, when the detector output indicates that ambient or wind noise is detected, the noise suppressor 308 removes at least one of a residual noise or a residual non-linear acoustic echo in the mixed signal to generate an enhanced mixed signal. The noise suppressor 308 may be a one-channel or two-channel noise suppressor and may include a residual echo suppressor.

In one embodiment, the enhanced mixed signal may be in the frequency domain. In FIG. 3, a frequency-time transformer (FBs) 309 transforms the enhanced mixed signal from a frequency domain to a time domain. The transformation from frequency to time domain may be achieved by filter bank synthesis or other methods such as inverse Fast Fourier Transform (iFFT). In one embodiment, the enhanced mixed signal in a time domain is the uplink signal.

The following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 5A:
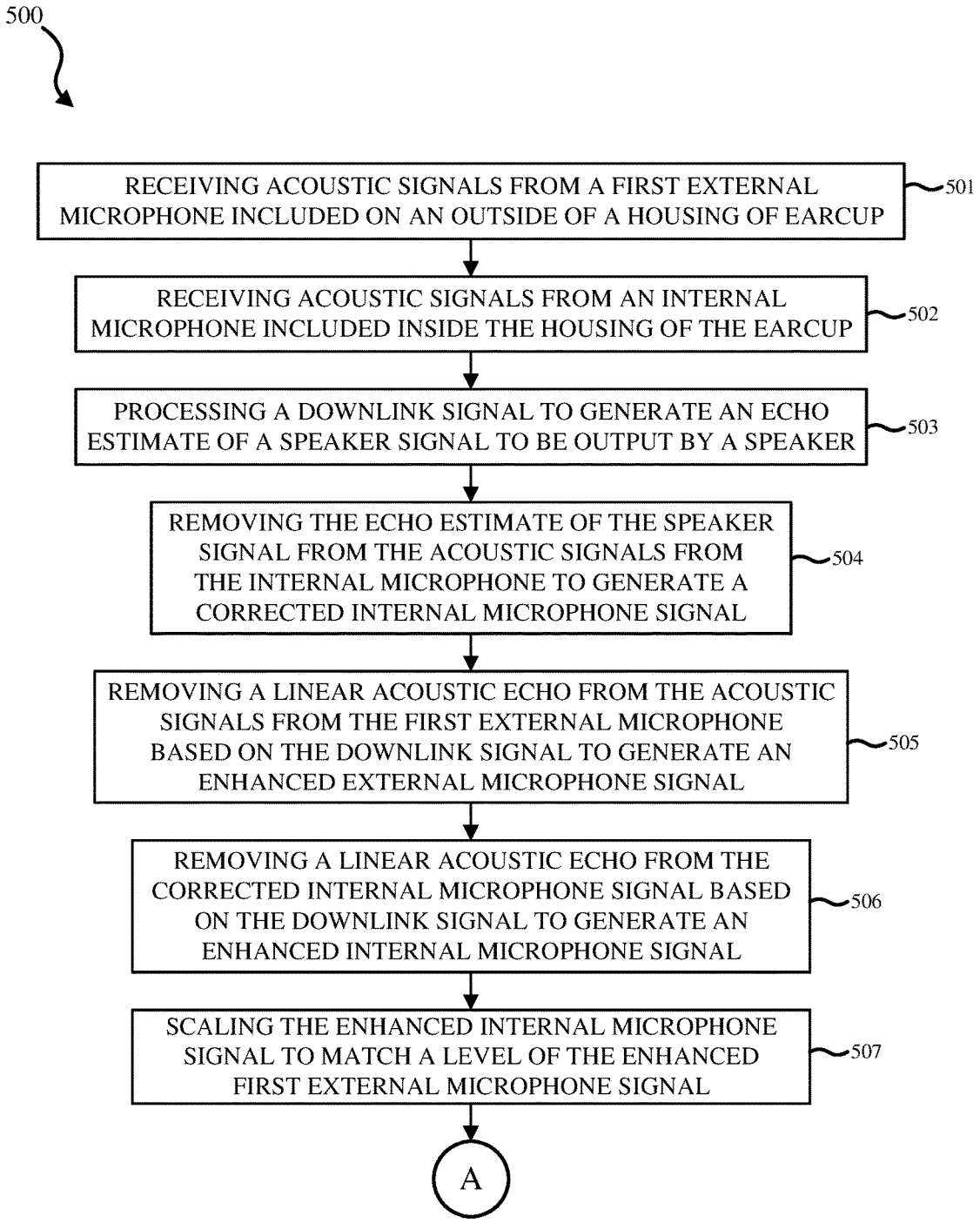
FIGS. 5A-B illustrates a flow diagram of an example method of wind and noise reduction for a headphone according to one embodiment of the invention.
Figure 5B:
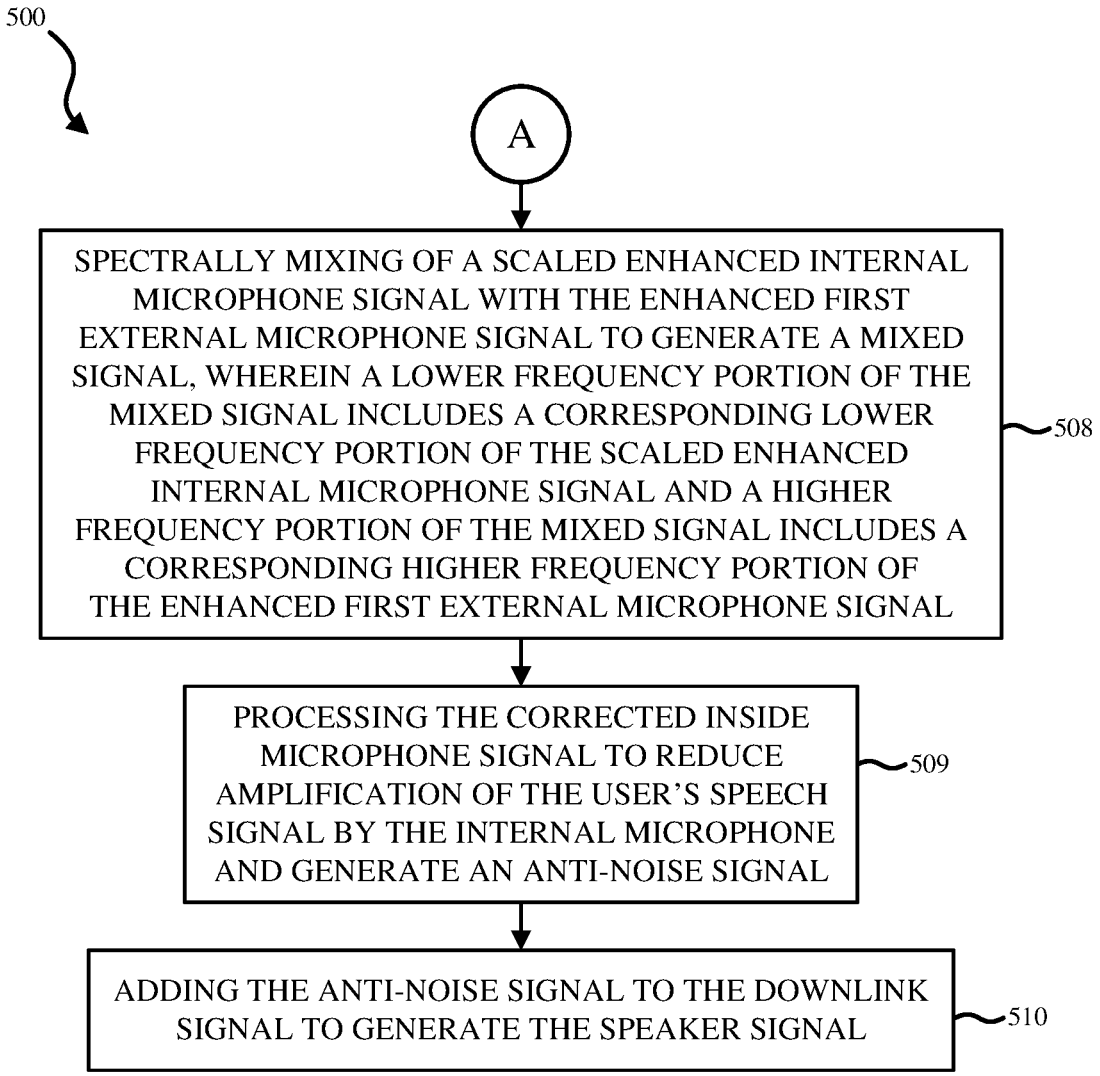

FIGS. 5A-B illustrates a flow diagram of an example method 500 of wind and noise reduction for a headphone according to one embodiment of the invention. Method 500 starts by receiving acoustic signals from a first external microphone $\mathbf{11}_1$ that is included on an outside of a housing of a first earcup $\mathbf{10}_1$ (Block 501). At Block 502, the acoustic signals are received from an internal microphone $\mathbf{11}_3$ included inside the housing of the first earcup $\mathbf{10}_1$. The internal microphone $\mathbf{11}_3$ may be at a location closest to the user's ear canal when the headphone is worn on the user's ears.

At Block 503, the ANC downlink corrector 318 processes a downlink signal to generate an echo estimate of a speaker signal to be output by a speaker 316. At Block 504, a first summator $\mathbf{304}_1$ removes the echo estimate of the speaker signal from the acoustic signals from the internal microphone $\mathbf{11}_3$ to generate a corrected internal microphone signal.

At Block 505, a first AEC $\mathbf{303}_1$ removes a linear acoustic echo from the acoustic signals from the first external microphone $\mathbf{11}_3$ based on the downlink signal to generate an enhanced first external microphone signal. At Block 506, a second AEC (e.g., AEC $\mathbf{303}_3$) removes a linear acoustic echo from the corrected internal microphone signal based on the downlink signal to generate an enhanced internal microphone signal.

At Block 507, an equalizer 310 scales the enhanced internal microphone signal to match a level of the enhanced first external microphone signal. At Block 508, the spectral combiner 307 spectrally mixes of the output of the equalizer (e.g., equalized corrected internal microphone signal) with the enhanced first external microphone signal to generate a mixed signal. In one embodiment, a lower frequency portion of the mixed signal includes a corresponding lower frequency portion of the output of the equalizer and a higher frequency portion of the mixed signal includes a corresponding higher frequency portion of the enhanced first external microphone signal. At Block 509, a feedback ANC corrector 313 processes the corrected internal microphone signal to reduce amplification of the user's speech signal by the internal microphone and to generate an anti-noise signal. At Block 510, a second summator $\mathbf{304}_2$ adds the anti-noise signal to the downlink signal to generate the speaker signal to be output by the speaker.

Figure 6:
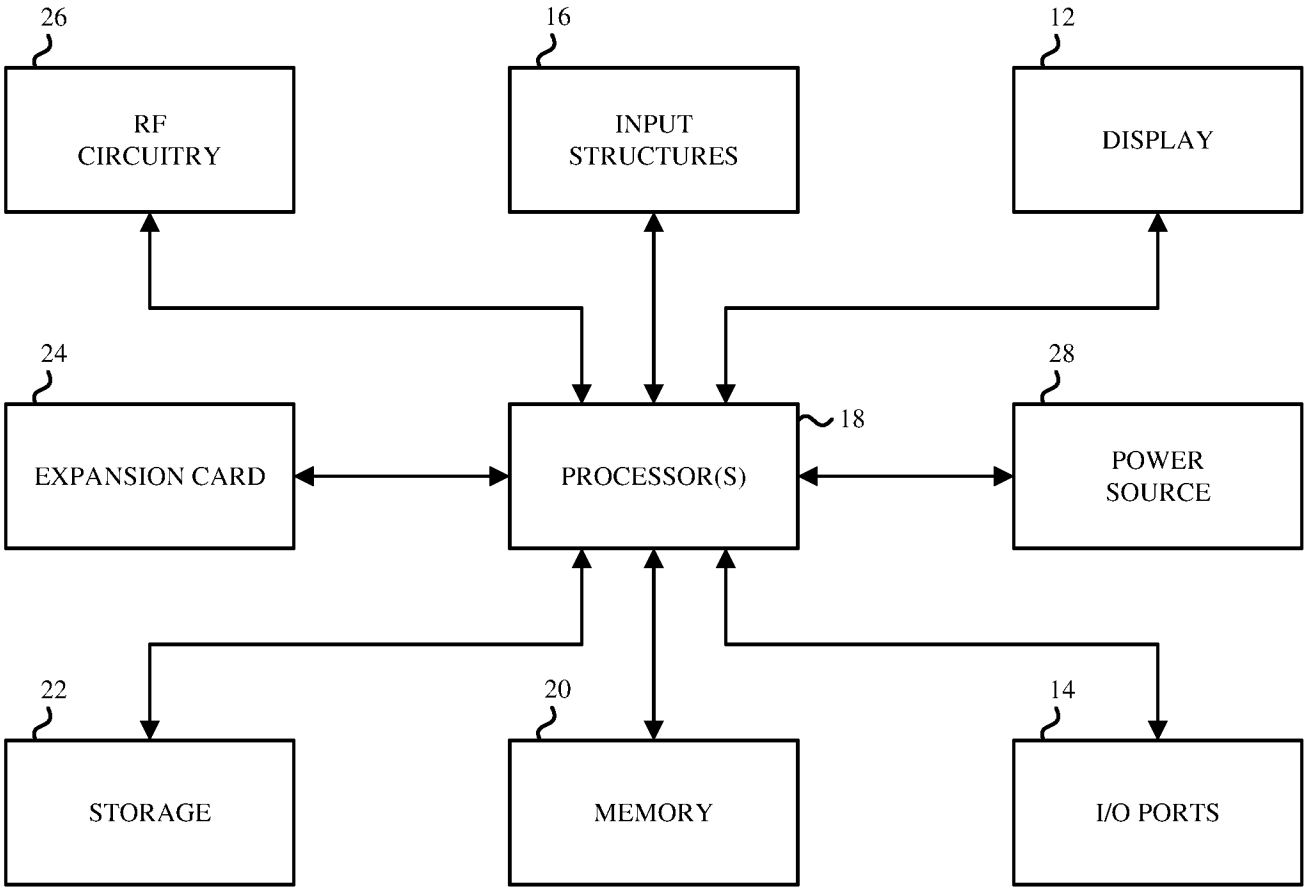
FIG. 6 is a block diagram of exemplary components of an electronic device in which at least portions of the system in FIG. 3 of wind and noise reduction for a headphone may be implemented in accordance with aspects of the present disclosure.

FIG. 6 is a block diagram of exemplary components of an electronic device in which at least portions of the system in FIG. 3 of wind and noise reduction for a headphone may be implemented in accordance with aspects of the present disclosure. Specifically, FIG. 6 is a block diagram depicting various components that may be present in electronic devices suitable for use with the present techniques. The electronic device 100 may be in the form of a computer, a handheld portable electronic device such as a cellular phone, a mobile device, a personal data organizer, a computing device having a tablet-style form factor, etc. These types of electronic devices, as well as other electronic devices providing comparable voice communications capabilities (e.g., VoIP, telephone communications, etc.), may be used in conjunction with the present techniques.

Keeping the above points in mind, FIG. 6 is a block diagram illustrating components that may be present in one such electronic device, and which may allow the device 100 to function in accordance with the techniques discussed herein. The various functional blocks shown in FIG. 6 may include hardware elements (including circuitry), software elements (including computer code stored on a computer-readable medium, such as a hard drive or system memory), or a combination of both hardware and software elements. It should be noted that FIG. 6 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. A method of noise reduction for a headphone comprising:

receiving an acoustic signal from an external microphone positioned outside a housing of an earcup of the headphone;

receiving an acoustic signal from an internal microphone positioned inside the housing of the earcup;

processing a downlink signal to generate an estimate of a speaker signal that is to be output by a speaker of the headphone;

removing the estimate of the speaker signal from the acoustic signal from the internal microphone to generate a corrected internal microphone signal;

spectrally mixing the corrected internal microphone signal with the acoustic signal from the external microphone to generate a mixed signal, wherein a lower frequency portion of the mixed signal includes a corresponding lower frequency portion of the corrected internal microphone signal, and a higher frequency portion of the mixed signal includes a corresponding higher frequency portion of the acoustic signal from the external microphone, processing the corrected internal microphone signal to generate an anti-noise signal; and adding the anti-noise signal to the downlink signal to generate the speaker signal to be output by the speaker.

2. The method of claim 1, further comprising:

transforming the acoustic signal from the external microphone, the acoustic signal from the internal microphone, and the downlink signal from a time domain to a frequency domain; and transforming an enhanced mixed signal from the frequency domain to the time domain.

3. The method of claim 1, further comprising:

removing a linear acoustic echo from the acoustic signal from the external microphone based on the downlink signal to generate an enhanced external microphone signal; and removing a linear acoustic echo from the corrected internal microphone signal based on the downlink signal to generate an enhanced internal microphone signal.

4. The method of claim 3, further comprising:

scaling the enhanced internal microphone signal to match a level of the enhanced external microphone signal.

5. The method of claim 4, further comprising:

amplifying the enhanced external microphone signal to generate an amplified enhanced external microphone signal, wherein the spectrally mixing comprises:

spectrally mixing of the scaled enhanced internal microphone signal with the amplified enhanced external microphone signal to generate the mixed signal.

6. The method of claim 1, further comprising:

transmitting the mixed signal as an uplink signal.

7. The method of claim 6, further comprising:

detecting a presence of noise, wherein noise includes at least one of: wind noise or ambient noise.

8. The method of claim 7, wherein spectrally mixing to generate the mixed signal is based on detecting the presence of noise.

9. The method of claim 8, further comprising:

removing at least one of a residual noise or a non-linear acoustic echo in the mixed signal based on detecting the presence of noise to generate an enhanced mixed signal.

10. A method of noise reduction for a headphone comprising:

receiving an acoustic signal from a first external microphone and an acoustic signal from a second external microphone, wherein the first and second external microphones are included on an outside of a housing of an earcup of the headphone, generating a voicebeam signal based on the first external microphone signal and the second external microphone signal;

receiving an acoustic signal from an internal microphone included inside the housing of the earcup;

processing a downlink signal to generate an estimate of a speaker signal that is to be output by a speaker of the headphone;

removing the estimate of the speaker signal from the acoustic signal from the internal microphone to generate a corrected internal microphone signal;

spectrally mixing of the corrected internal microphone signal with the voicebeam signal to generate a mixed signal, wherein a lower frequency portion of the mixed signal includes a corresponding lower frequency portion of the corrected internal microphone signal, and a higher frequency portion of the mixed signal includes a corresponding higher frequency portion of the voicebeam signal, processing the corrected internal microphone signal to generate an anti-noise signal; and adding the anti-noise signal to the downlink signal to generate the speaker signal to be output by the speaker.

11. The method of claim 10, further comprising:

transforming the acoustic signal from the first external microphone, the acoustic signal from the second external microphone, the acoustic signal from the internal microphone, and the downlink signal from a time domain to a frequency domain; and transforming an enhanced mixed signal from the frequency domain to the time domain.

12. The method of claim 10, further comprising:

transmitting the mixed signal as an uplink signal.

13. The method of claim 12, further comprising:

scaling the enhanced internal microphone signal to match a level of the enhanced first external microphone signal, wherein spectrally mixing comprises:

spectrally mixing of a scaled enhanced internal microphone signal with the voicebeam signal to generate the mixed signal.

14. The method of claim 13, further comprising:

detecting a presence of noise, wherein noise includes at least one of: wind noise or ambient noise, wherein spectrally mixing to generate the mixed signal is based on detecting the presence of noise.

15. The method of claim 14, further comprising:

removing at least one of a residual noise or a non-linear acoustic echo in the mixed signal based on detecting the presence of noise to generate an enhanced mixed signal.

16. A system of noise reduction for a headphone comprising:

a speaker to output a speaker signal based on a downlink signal;

an earcup of the headphone includes a first external microphone included on an outside of a housing of the earcup, and an internal microphone included inside the housing of the earcup;

an active-noise cancellation (ANC) downlink corrector to process the downlink signal to generate an estimate of the speaker signal;

a first summator to remove the estimate of the speaker signal from an acoustic signal from the internal microphone to generate a corrected internal microphone signal;

a first acoustic echo canceller to remove a linear acoustic echo from an acoustic signal from the first external microphone based on the downlink signal to generate an enhanced first external microphone signal; and a second acoustic echo canceller to remove a linear acoustic echo from the corrected internal microphone signal based on the downlink signal to generate an enhanced internal microphone signal;

an equalizer to scale the enhanced internal microphone signal to match a level of the enhanced first external microphone signal;

a spectral combiner to spectrally mix the enhanced internal microphone signal with the enhanced first external microphone signal to generate a mixed signal, wherein a lower frequency portion of the mixed signal includes a corresponding lower frequency portion of the enhanced internal microphone signal, and a higher frequency portion of the mixed signal includes a corresponding higher frequency portion of the enhanced first external microphone signal.

17. The system of claim 16, further comprising:

a communications interface to transmit the mixed signal as an uplink signal.

18. The system of claim 17, further comprising:

a feedback ANC corrector to process the corrected internal microphone signal to reduce amplification of a user's speech signal and of the ambient noise signal in the internal microphone and to generate an anti-noise signal; and a second summator to add the anti-noise signal to the downlink signal to generate the speaker signal.

19. The system of claim 18, further comprising:

an amplifier to amplify the enhanced first external microphone signal to generate an amplified enhanced first external microphone signal, wherein the spectral combiner spectrally mixing comprises:

spectrally mixing of an output of the equalizer with the amplified enhanced first external microphone signal to generate the mixed signal.

20. The system of claim 19, further comprising:

a wind and noise detector to detect a presence of noise, wherein noise includes at least one of: wind noise or ambient noise.

21. The system of claim 20, wherein the spectral combiner spectrally mixes to generate the mixed signal based on detecting the presence of noise.

22. The system of claim 21, further comprising:

a noise suppressor to remove at least one of a residual noise or a residual non-linear acoustic echo in the mixed signal based on detecting the presence of noise to generate an enhanced mixed signal.

* * * * *